US009167367B2

(12) United States Patent
Hoang et al.

(10) Patent No.: US 9,167,367 B2
(45) Date of Patent: Oct. 20, 2015

(54) OPTIMIZED LOW-BIT RATE PARAMETRIC CODING/DECODING

(75) Inventors: Thi Minh Nguyet Hoang, Sundbyberg (SE); Stephane Ragot, Lannion (FR); Balazs Kovesi, Lannion (FR)

(73) Assignee: FRANCE TELECOM, Paris (FR)

( * ) Notice: Subject to any disclaimer, the term of this patent is extended or adjusted under 35 U.S.C. 154(b) by 618 days.

(21) Appl. No.: 13/502,316

(22) PCT Filed: Oct. 15, 2010

(86) PCT No.: PCT/FR2010/052192

§ 371 (c)(1),
(2), (4) Date: Apr. 16, 2012

(87) PCT Pub. No.: WO2011/045548

PCT Pub. Date: Apr. 21, 2011

(65) Prior Publication Data

US 2012/0207311 A1 Aug. 16, 2012

(30) Foreign Application Priority Data

Oct. 15, 2009 (FR) ..... 09 57254

(51) Int. Cl.

| | |
|---|---|
| ***H04R 5/00*** | (2006.01) |
| ***H04S 3/00*** | (2006.01) |
| ***G10L 19/008*** | (2013.01) |
| *G10L 19/16* | (2013.01) |

(52) U.S. Cl.

CPC ..... *H04S 3/008* (2013.01); *G10L 19/008* (2013.01); *G10L 19/167* (2013.01); *H04S 2420/03* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,829,489 | B2 * | 12/2004 | Yamamoto et al. | 455/522 |
| 7,006,555 | B1 * | 2/2006 | Srinivasan | 375/133 |
| 7,644,001 | B2 * | 1/2010 | Schuijers et al. | 704/500 |
| 8,054,981 | B2 * | 11/2011 | Roden et al. | 381/23 |
| 2003/0142746 | A1 * | 7/2003 | Tanaka et al. | 375/240.11 |
| 2006/0235679 | A1 * | 10/2006 | Sperschneider et al. | 704/206 |

(Continued)

FOREIGN PATENT DOCUMENTS

| | | | |
|---|---|---|---|
| WO | 2006108464 | A1 | 10/2006 |
| WO | WO 2006126857 | A2 * | 11/2006 |

OTHER PUBLICATIONS

Manuel Briand, Parametric coding of stereo audio based on Prociipal component analysis', Sep. 20, 2006, pp. 291-296.*

(Continued)

*Primary Examiner* — Duc Nguyen
*Assistant Examiner* — Assad Mohammed
(74) *Attorney, Agent, or Firm* — David D. Brush; Westman, Champlin & Koehler, P.A.

(57) ABSTRACT

A parametric coding method and apparatus are provided for coding a multichannel digital audio signal. The method includes a coding step for coding a signal from a channel reduction matrixing of the multichannel signal. The coding method also includes: obtaining, for each frame of predetermined length, spatial information parameters of the multichannel signal; dividing the spatial information parameters into a plurality of blocks of parameters; selecting a block of parameters as a function of the index of the current frame; and coding the block of parameters selected for the current frame.

16 Claims, 7 Drawing Sheets

(56) References Cited

U.S. PATENT DOCUMENTS

| | | | | |
|---|---|---|---|---|
| 2008/0224901 | A1 | 9/2008 | Pang et al. | |
| 2009/0222272 | A1 * | 9/2009 | Seefeldt et al. | 704/500 |

OTHER PUBLICATIONS

Manuel Briand, "Parametric coding of stereo audio based on Principal components analysis", Sep. 20, 2006, pp. 291-296.*

International Preliminary Report on Patentability and English translation of the Written Opinion, dated May 8, 2012 for corresponding International Application No. PCT/FR2010/052192, filed Oct. 15, 2010.

International Search Report and Written Opinion dated Feb. 7, 2011 for corresponding International Application No. PCT/FR2010/052192, filed Oct. 15, 2010.

Breebaart J. et al., "Parametric Coding of Stereo Audio", EURASIP Journal of Applied Signal Processing, Jun. 1, 2005, pp. 1305-1322, XP002514252.

Briand et al., "Parametric Coding of Stereo Audio Based on Principal Component Analysis" Proceedings of the 9th Int. Conf. On Digital Audio Effects (DAFX-06), Sep. 20, 2006, pp. 291-296, XP002579979.

* cited by examiner

OPTIMIZED LOW-BIT RATE PARAMETRIC CODING/DECODING

CROSS-REFERENCE TO RELATED APPLICATIONS

This Application is a Section 371 National Stage Application of International Application No. PCT/FR2010/052192, filed Oct. 15, 2010, which is incorporated by reference in its entirety and published as WO 2011/045548 on Apr. 21, 2011, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The present disclosure relates to the field of coding/decoding of digital signals.

The coding and decoding according to the invention is suited in particular for the transmission and/or the storage of digital signals such as audio frequency signals (speech, music or similar).

More particularly, the present disclosure relates to the parametric coding/decoding of multichannel audio signals.

BACKGROUND OF THE DISCLOSURE

This type of coding/decoding is based on the extraction of spatial information parameters so that, on decoding, these spatial characteristics can be reconstructed for the listener.

This type of parametric coding is applied in particular for a stereo signal. Such a coding/decoding technique is, for example, described in the document Breebaart, J. and van de Par, S and Kohlrausch, A. and Schuijers, entitled "Parametric Coding of Stereo Audio" in EURASIP Journal on Applied Signal Processing 2005:9, 1305-1322. This example is reprised with reference to FIGS. 1 and 2 respectively describing a parametric stereo coder and decoder.

Thus, FIG. 1 describes a coder receiving two audio channels, a left channel (denoted L) and a right channel (denoted R).

The channels L(n) and R(n) are processed by blocks 101, 102 and 103, 104 respectively which perform a short-term Fourier analysis. The transformed signals L[j] and R[j] are thus obtained.

The block 105 performs a channel reduction matrixing, or "Downmix" to obtain from the left and right signals a sum signal, a mono signal in the present case, in the frequency domain.

An extraction of spatial information parameters is also performed in the block 105.

The parameters of ICLD ("InterChannel Level Difference") type, also called interchannel intensity difference, characterize the energy ratios for each frequency subband between the left and right channels.

They are defined in dB by the following formula:

$$ICLD[k] = 10 \cdot \log_{10}\left(\frac{\sum_{j=B[k]}^{B[k+1]-1} L[j] \cdot L^*[j]}{\sum_{j=B[k]}^{B[k+1]-1} R[j] \cdot R^*[j]}\right) \text{dB} \quad (1)$$

in which L[j] and R[j] correspond to the (complex) spectral coefficients of the channels L and R, the values B[k] and B[k+1], for each frequency band k, define the subdivision into sub-bands of the spectrum and the symbol * indicates the complex conjugate.

A parameter of ICPD ("InterChannel Phase Difference") type, also called phase difference for each frequency sub-band, is defined according to the following relationship:

$$\text{ICPD}[k]=\angle(\Sigma_{j=B[k]}^{B[k+1]-1} L[j] \cdot R^*[j]) \quad (2)$$

in which ∠ indicates the argument (the phase) of the complex operand.

In a manner equivalent to the ICPD, it is also possible to define an interchannel time difference (ICTD).

An interchannel coherence (ICC) parameter represents the interchannel correlation.

These parameters ICLD, ICPD and ICC are extracted from the stereo signals by the block 105.

The monosignal is passed into the time domain (blocks 106 to 108) after short-term Fourier synthesis (inverse FFT, windowing and overlap-add (OLA)) and a mono coding (block 109) is performed. In parallel, the stereo parameters are quantized and coded in the block 110.

In general, the spectrum of the signals (L[j],R[j]) is divided according to a nonlinear frequency scale of ERB (Equivalent Rectangular Bandwidth) or Bark type, with a number of sub-bands ranging typically from 20 to 34. This scale defines the values of B(k) and B(k+1) for each sub-band k. The parameters (ICLD, ICPD, ICC) are coded by scalar quantization possibly followed by an entropic coding or a differential coding. For example, in the paper cited previously, the ICLD is coded by a nonuniform quantizer (ranging from −50 to +50 dB) with differential coding; the non-uniform quantization step exploits the fact that the greater the ICLD value, the lower the auditory sensitivity to the variations of this parameter.

In the decoder 200, the monosignal is decoded (block 201), and a decorrelator is used (block 202) to produce two versions $\hat{M}(n)$ and $\hat{M}'(n)$ of the decoded monosignal. These two signals passed into the frequency domain (blocks 203 to 206) and the decoded stereo parameters (block 207) are used by the stereo synthesis (block 208) to reconstruct the left and right channels in the frequency domain. These channels are finally reconstructed in the time domain (blocks 209 to 214).

In stereo signal coding techniques, an intensity stereo coding technique consists in coding the sum channel (M) and the energy ratios ICLD as defined above.

Intensity stereo coding exploits the fact that perception of the high-frequency components is mainly linked to the time (energy) envelopes of the signal.

For monosignals, there are also quantization techniques with or without memory such as the "pulse-code modulation" (PCM) coding or its adaptive version called "adaptive differential pulse-code modulation" (ADPCM).

Interest here is more particularly focused on ITU-T Recommendation G.722 which uses ADPCM (adaptive differential pulse code modulation) coding with code nested in sub-bands.

The input signal of a G.722-type coder is wideband with a minimum bandwidth of [50-7000 Hz] with a sampling frequency of 16 kHz. This signal is broken down into two sub-bands [0-4000 Hz] and [4000-8000 Hz] obtained by breakdown of the signal by quadrature mirror filters (QMF), then each of the sub-bands is separately coded by an ADPCM coder.

The low band is coded by an ADPCM coding with nested codes on 6, 5 and 4 bits whereas the high band is coded by an ADPCM coder of two bits per sample. The total bit rate is 64, 56 or 48 bit/s depending on the number of bits used for the decoding of the low band.

Recommendation G.722 was first used in the ISDN (integrated services digital network), then in enhanced telephony applications on HD (high definition) voice quality IP networks.

A quantized signal frame according to the G.722 standard is made up of quantization indices coded on 6, 5 or 4 bits in the low band (0-4000 Hz) and 2 bits in the high band (4000-8000 Hz). Since the transmission frequency of the scalar indices is 8 kHz in each sub-band, the bit rate is 64, 56 or 48 Kbit/s. In the G.722 standard, the 8 bits are distributed as follows: 2 bits for the high band, 6 bits for the low band. The last or the last two bits of the low band can be "stolen" or replaced by data.

The ITU-T has recently launched a standardization activity called G.722-SWB (in the context of the Q.10/16 issue described, for example, in the document: ITU-document: Annex Q10.J Terms of Reference (ToR) and time schedule for the super wideband extension to ITU-T G.722 and ITU-T G.711WB, January 2009, WD04_G722G711SWBToRr3.doc) which consists in extending the G.722 Recommendation in two ways:

- An extension of the acoustic band from 50-7000 Hz (wideband) to 50-14000 Hz (super-wide band, SWB).
- An extension from mono to stereo. This stereo extension can extend a mono coding in wideband or a mono coding in super-wideband.

In the context of G.722-SWB, the G.722 coding works with short 5 ms frames.

The focus of interest here is more particularly on the stereo extension of the wideband G.722 coding.

Two G.722 stereo extension modes are to be tested in the G.722-SWB standardization:

- A 56 Kbit/s G.722 stereo extension with an additional bit rate of 8 Kbit/s, or 64 Kbit/s in total
- a 64 Kbit/s G.722 extension with an additional bit rate of 16 Kbit/s, or 80 Kbit/s in total.

The spatial information represented by the ICLD or other parameters requires an (additional stereo extension) bit rate that is all the greater when the coding frames are short.

As an example, in the context of the G.722-SWB standardization, if it is assumed that a G.722 (wideband) stereo extension is implemented by the intensity coding technique, the following stereo extension bit rate is obtained.

For a sum (mono) signal coded by G.722 with a 5 ms frame and a breakdown of the wideband spectrum (0-8000 Hz) into 20 sub-bands, 20 ICLD parameters to be transmitted every 5 ms are obtained. It can be assumed that these ICLD parameters are coded with an (average) bit rate of the order of 4 bits per sub-band. The G.722 stereo extension bit rate therefore becomes 20×4 bits/5 ms=16 Kbit/s. Thus, the G.722 stereo extension by ICLD with 20 sub-bands results in an additional bit rate of the order of 16 Kbit/s. Now, according to the prior art, ICLD coding on its own is not generally sufficient to achieve a good stereo quality.

This example therefore illustrates the difficulty in producing a stereo extension of a coder such as G.722 with short (5 ms) frames.

A direct coding of the ICLD (with no other parameters) gives an additional (stereo extension) bit rate of around 16 Kbit/s which is already the maximum possible extension bit rate for the G.722 extension.

There is therefore a need to represent the stereo, or more generally multichannel signal, effectively, with a bit rate that is as low as possible, with an acceptable quality, when the coding frames are short.

SUMMARY

An aspect of the present disclosure relates to, in one embodiment, a parametric coding method for a multichannel digital audio signal comprising a coding step (G.722 Cod) for coding a signal from a channel reduction matrixing of the multichannel signal.

The method is such that it also comprises the following steps:

- obtaining (Obt.), for each frame of predetermined length, spatial information parameters of the multichannel signal;
- dividing (Div.) the spatial information parameters into a plurality of blocks of parameters;
- selecting (St.) a block of parameters as a function of the index of the current frame;
- coding (Q) the block of parameters selected for the current frame.

Thus, the spatial information parameters are divided into a number of blocks, coded on a number of frames. The coding bit rate is therefore distributed over a number of frames, the coding of this information is therefore done at a lower bit rate.

The various particular embodiments mentioned below can be added independently or in combination with one another, in the steps of the method defined above.

In one embodiment, the spatial information parameters, are obtained by means of the following steps:

- frequency transformation (Fen., FFT) of the multichannel signal to obtain the spectra of the multichannel signal, for each frame;
- subdivision (D), for each frame, of the spectra of the multichannel signal, into a plurality of frequency sub-bands,
- computation of the spatial information parameters for each frequency sub-band.

The division of the spatial information parameters is performed as a function of the frequency sub-bands obtained by subdivision.

This distribution by blocks is performed according to the frequency sub-bands defined, so as to optimize the use of these parameters and minimize the impact on the quality of the multichannel signal.

Said spatial information parameters are advantageously defined as the energy ratio between the channels of the multichannel signal.

These parameters make it possible to best define the directions of the sound sources and therefore define, for example for a stereo signal, the characteristics of the left and right signals reconstructed on decoding.

In a particular embodiment, the coding of a block of spatial information parameters is performed by non-uniform scalar quantization.

This quantization is adapted to use a minimum of bit rate in addition to a multichannel extension of the coding.

In a first embodiment, the step of division of the parameters makes it possible to obtain two blocks, a first block corresponding to the parameters of the first frequency sub-bands and a second block corresponding to the parameters of the last frequency sub-bands obtained by subdivision.

In another particular embodiment, the step of division of the parameters makes it possible to obtain two blocks interleaving the parameters of the different frequency sub-bands.

This distribution of the parameters is therefore performed simply and effectively. The distribution of the parameters over two contiguous blocks adds the advantage of allowing for a conventional differential coding.

Advantageously, the coding of the first block and of the second block is performed according to whether the frame to be coded has an even index or an odd index.

Thus, the parameters are refreshed at short intervals, which means that there is no added perceptual degradation on decoding.

In another embodiment, the method also comprises a principal component analysis step to obtain the spatial information parameters comprising a rotation angle parameter and an energy ratio between a principal component and an ambience signal.

This particular way of obtaining spatial information parameters makes it possible to also take into account the correlations that exist between different channels of the multichannel signal.

An embodiment of the invention also applies to a parametric decoding method for a multichannel digital audio signal comprising a decoding step (G.722 Dec) for decoding a signal from a channel reduction matrixing of the multichannel signal. The method is such that it also comprises the following steps:

- decoding spatial information parameters received for a current frame of predetermined length of the decoded signal;
- storing the decoded parameters for the current frame;
- obtaining the decoded and stored parameters of at least one preceding frame and associating these parameters with those decoded for the current frame;
- reconstructing the multichannel signal from the decoded signal and from the association of parameters obtained for the current frame.

Thus, on decoding, the spatial information parameters are received on a number of successive frames and are decoded in succession without requiring excessive additional bit rate.

Obtaining these spatial parameters makes it possible to obtain the good quality reconstruction of the multichannel signal.

In the same way as for the coding method, the decoded and stored parameters of a preceding frame correspond to the parameters of the first frequency sub-bands of the decoding frequency band and the decoded parameters of the current frame correspond to the parameters of the last frequency sub-bands obtained by subdivision or vice versa.

An embodiment of the invention also relates to a coder implementing the coding method comprising a coding module (304) for coding a signal obtained from a channel reduction matrixing of the multichannel signal. The coder is such that it also comprises:

- a module for obtaining, for each frame of predetermined length, spatial information parameters of the multichannel signal;
- a module for dividing the spatial information parameters into a plurality of blocks of parameters;
- a module for selecting a block of parameters as a function of the index of the current frame;
- a coding module for coding the block of parameters selected for the current frame.

An embodiment of the invention also relates to a decoder implementing the decoding method and comprising a decoding module for decoding a signal obtained from a channel reduction matrixing of the multichannel signal. The decoder also comprises:

- a decoding module for decoding spatial information parameters received for a current frame of predetermined length of the decoded signal;
- storage space for storing the parameters for the current frame;
- a module for obtaining the decoded and stored parameters of at least one preceding frame and associating these parameters with those decoded for the current frame;
- a reconstruction module for reconstructing the multichannel signal from the decoded signal and from the association of parameters obtained for the current frame.

It also relates to a computer program comprising code instructions for implementing the steps of the coding method as described and to a computer program comprising code instructions for implementing the steps of a decoding method as described, when they are executed by a processor.

An embodiment of the invention finally relates to a processor-readable storage means storing a computer program as described.

BRIEF DESCRIPTION OF THE DRAWINGS

Other features and advantages will become more clearly apparent on reading the following description, given solely as a nonlimiting example, and given with reference to the appended drawings in which.

DETAILED DESCRIPTION OF ILLUSTRATIVE EMBODIMENTS

Figure 1:
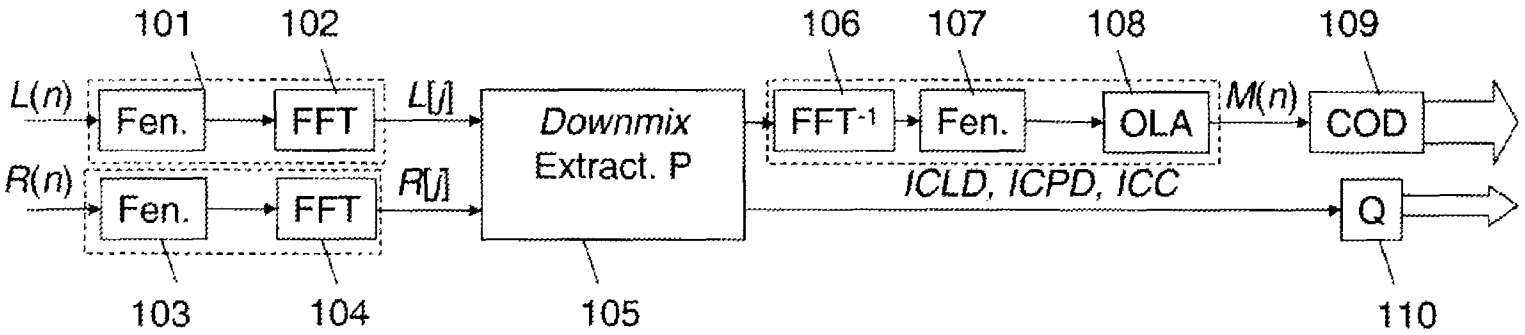
Fig.1 (Prior art)
FIG. 1 illustrates a coder implementing a parametric coding known from the prior art and described previously.
Figure 2:
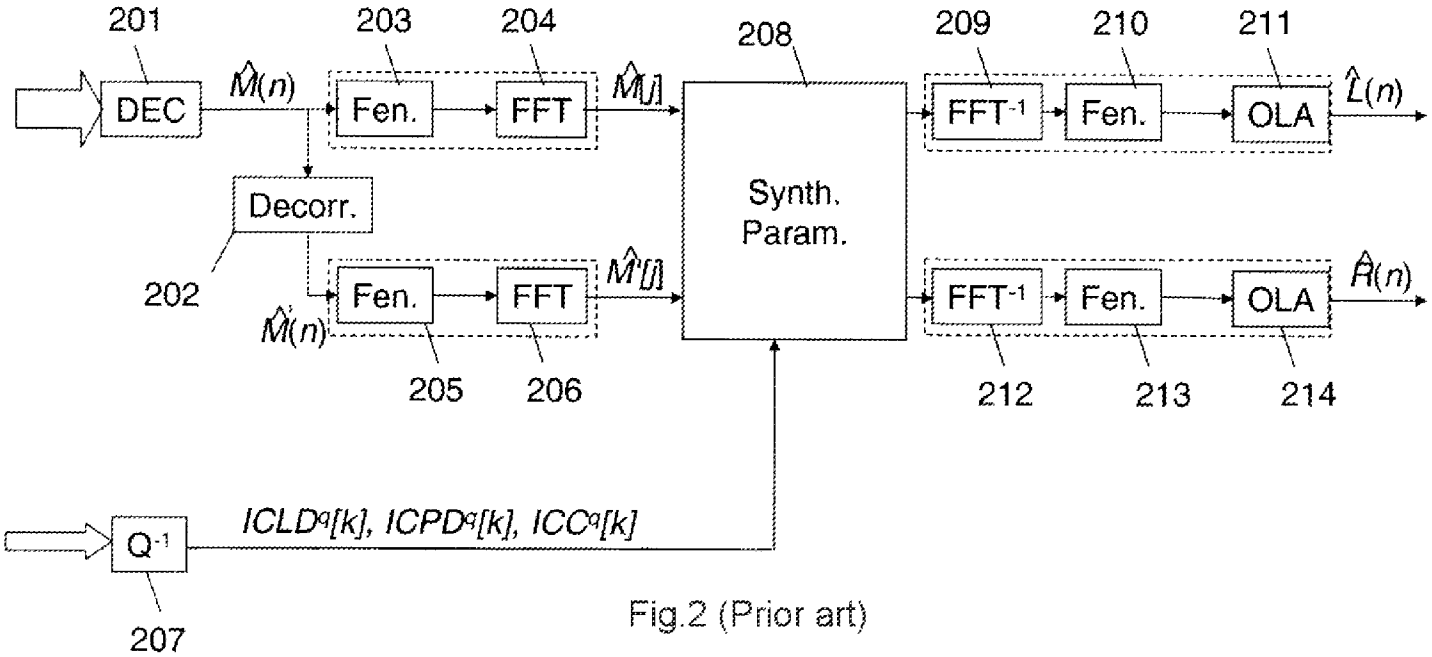
Fig.2 (Prior art)
FIG. 2 illustrates a decoder implementing a parametric decoding known from the prior art and described previously.
Figure 3:
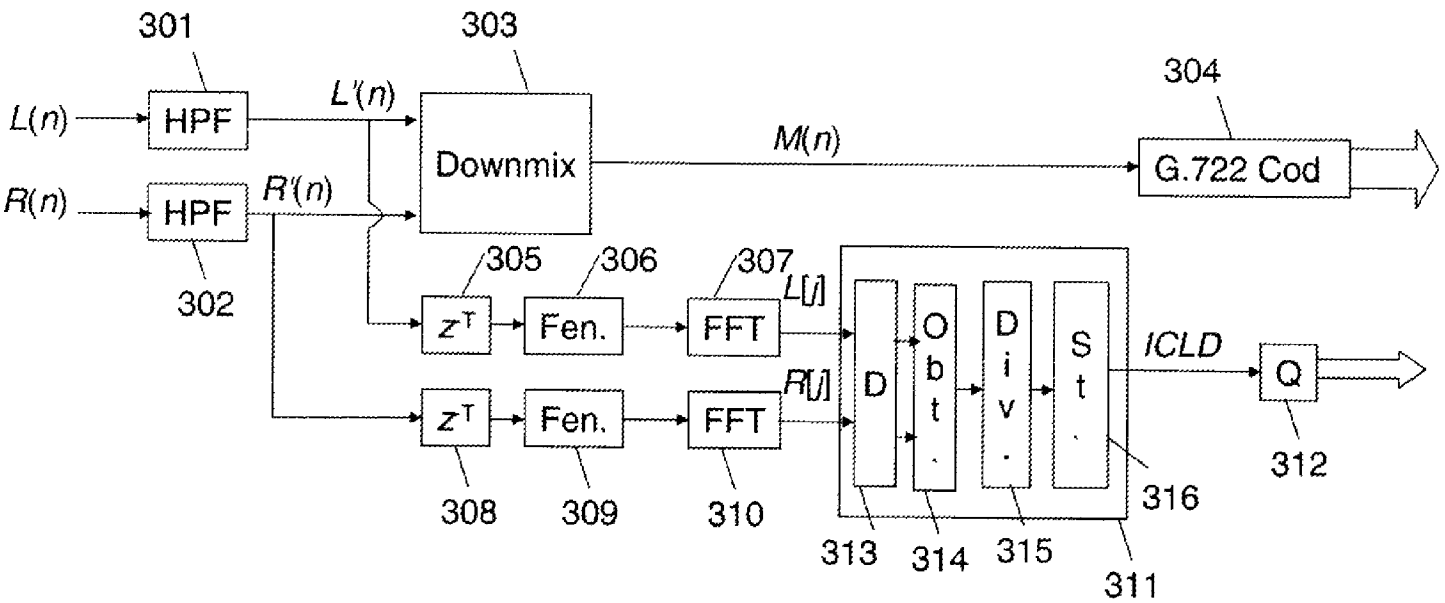
FIG. 3 illustrates a coder according to one embodiment of the invention, implementing a coding method according to one embodiment of the invention.

With reference to FIG. 3, a first embodiment of a stereo signal coder implementing a coding method according to a first embodiment is now described.

This parametric stereo coder works in wideband mode with stereo signals sampled at 16 kHz with 5 ms frames. Each channel (L and R) is first prefiltered by a high-pass filter (HPF) eliminating the components below 50 Hz (blocks 301 and 302). Next, a mono signal (M) is calculated by the block 303, of which an exemplary embodiment is given in the form:

$$M(n)=\tfrac{1}{2}(L'(n)+R'(n))$$

This signal is coded (block 304) by a G.722-type coder, as described, for example, in ITU-T Recommendation G.722, 7 kHz audio-coding within 64 Kbit/s, November 1988.

The delay introduced into the G.722-type coding is 22 samples at 16 kHz. The L and R channels are aligned in time (blocks 305 and 308) with a delay of T=22 samples and analyzed in frequency by transform, for example by discrete Fourier transform with sinusoidal windowing with an overlap which, in the example here, is of 50% (blocks 306, 307 and 309, 310). Each window thus covers two 5 ms frames or 10 ms (160 samples).

Figure 5:
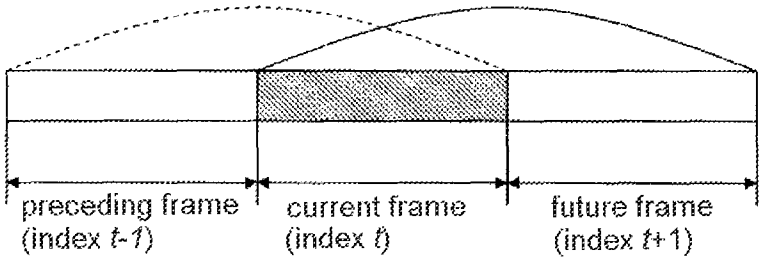
FIG. 5 illustrates the division of a digital audio signal into frames in a coder implementing a coding method according to one embodiment of the invention.

The division of the signal into frames is defined with reference to FIG. 5. This figure illustrates the fact that the analysis window (solid line) of 10 ms covers the current frame of index t and the future frame of index t+1 and the fact that an overlap of 50% is used between the window of the current frame and the window (dotted line) of the preceding frame.

Taking the future frame into account therefore induces an additional algorithmic delay of 5 ms on the coder.

For the frame t, the spectra obtained, L[t, j] and R[t, j] (j=0 . . . 79), at the output of the blocks 307 and 310 of FIG. 3, comprise 80 complex samples, with a resolution of 100 Hz per frequency ray.

The spatial information parameter extraction block 311 is now detailed.

This comprises, in the case of processing in the frequency domain, a first module 313 subdividing the spectra L[t, j] and R[t, j] into a predetermined number of frequency sub-bands, for example, here, into 20 sub-bands according to the scale defined below:

$$\{B(k)\}_{k=0,\ldots,20}=[0,1,2,3,4,5,6,7,9,11,13,16,19,23,27,31,37,44,52,61,80]$$

This scale delimits (as a number of Fourier coefficients) the frequency sub-bands of index k=0 to 19. For example, the first sub-band (k=0) goes from the coefficient B(k)=0 to B(k+1)−1=0; it is therefore reduced to a single coefficient (100 Hz).

Similarly, the last sub-band (k=19) goes from the coefficient B(k)=61 to B(k+1)−1=79 and it comprises 19 coefficients (1900 Hz).

The module 314 comprises means for obtaining the spatial information parameters of the stereo signal.

For example, the parameters obtained are the interchannel intensity difference parameters, ICLD.

For each frame of index t, the ICLD of the sub-band k=0, . . . , 19 is calculated according to the equation:

$$ICLD[t,k]=10\cdot\log_{10}\left(\frac{\sigma_L^2[t,k]}{\sigma_R^2[t,k]}\right)\text{dB} \tag{3}$$

in which $\sigma_L^2[t,k]$ and $\sigma_R^2[t,k]$ respectively represent the energy of the left channel (L) and of the right channel (R).

In a particular embodiment, these energies are calculated as follows:

$$\begin{cases}\sigma_L^2[t,k]=\sum_{j=B[k]}^{B[k+1]-1}L[t,j]\cdot L^*[t,j]+\sum_{j=B[k]}^{B[k+1]-1}L[t-1,j]\cdot L^*[t-1,j]\\ \sigma_R^2[t,k]=\sum_{j=B[k]}^{B[k+1]-1}R[t,j]\cdot R^*[t,j]+\sum_{j=B[k]}^{B[k+1]-1}R[t-1,j]\cdot R^*[t-1,j]\end{cases} \tag{4}$$

This formula amounts to combining the energy of two successive frames, which corresponds to a time support of 10 ms (15 ms if the effective time support of two successive windows is counted).

The module 314 therefore produces a series of ICLD parameters defined previously.

These ICLD parameters are divided, in the division module 315, into a number of blocks. In the embodiment illustrated here, the parameters are divided into two blocks according to the following two parts: $\{ICLD[t,k]\}_{k=0,\ldots,9}$ and $\{ICLD[t,k]\}_{k=10\ldots,19}$.

The division of the ICLD parameters into contiguous blocks makes it possible to perform a differential coding of the scalar quantization indices.

The module 316 then performs a selection (St.) of a block to be coded according to the index of the current frame to be coded.

In the example described here, for the frames t of even index, the block $\{ICLD[t,k]\}_{k=0,\ldots,19}$ is coded in 312 and transmitted, and for the frames t of odd index, the block $\{ICLD[t,k]\}_{k=10,\ldots,19}$ is coded in 312 and transmitted. The coding of these blocks in 312 is performed, for example, by non-uniform scalar quantization.

Thus, the coding of an ICLD block 10 is produced with:

5 bits for the first ICLD parameter, 4 bits for the next 8 ICLD parameters, 3 bits for the last (tenth) ICLD parameter.

A more detailed exemplary embodiment is, for example, as below:

For the quantization table:

$$\text{tab_}ild_q5[31]=\{-50,-45,-40,-35,-30,-25,-22,-19,-16,-13,-10,-8,-6,-4,-2,0,2,4,6,8,10,13,16,19,22,25,30,35,40,45,50\}$$

the 5-bit quantization of ICLD[t,k] consists in finding the quantization index i such that $$i=\arg\min j=0\ldots30|ICLD[t,k]-\text{tab_ild_}q5[j]|^2$$

Similarly, for the quantization table:

$$\text{tab_}ild_q4[15]=\{-16,-13,-10,-8,-6,-4,-2,0,2,4,6,8,10,13,16\}$$

the 4-bit quantization of ICLD[t,k] consists in finding the quantization index i such that $$i=\arg\min j=0\ldots15|ICLD[t,k]-\text{tab_ild_}q4[j]|^2$$

Finally, for the quantization table tab_ild_q3[7]={−16, −8, −4, 0, 4, 8, 16} the 3-bit quantization of ICLD[t,k] consists in finding the quantization index i such that $$i=\arg\min j=0\ldots15|ICLD[t,k]-\text{tab_ild_}q3[j]|^2$$

In total, 5+8×4+3=40 bits are therefore needed for coding a block of 10 ICLD. Since the frame is 5 ms, 40 bits/5 ms=8 Kbit/s is therefore obtained as additional bit rate for the stereo coding extension.

This bit rate is therefore not too great and is sufficient to effectively transmit the stereo parameters.

Two successive frames suffice in this exemplary embodiment for obtaining the spatial information parameters of the multichannel signal, the length of two frames being, most of the time, the length of an analysis window for a frequency transformation with 50% overlap.

In a variant, a shorter overlap window could be used to reduce the delay that is introduced.

Thus, the coder described with reference to FIG. 3 implements a parametric coding method for a multichannel digital audio signal comprising a coding step (G.722 Cod) for coding a signal obtained from a channel reduction matrixing of the multichannel signal. The method also comprises the following steps:

obtaining (Obt.), for each frame of predetermined length, spatial information parameters of the multichannel signal;

dividing (Div.) the spatial information parameters into a plurality of blocks of parameters;

selecting (St.) a block of parameters according to the index of the current frame;

coding (Q) the block of parameters selected for the current frame.

The embodiment described above relates to the context of a wideband coder operating with a sampling frequency of 16 kHz and a particular subdivision into sub-bands.

In another possible embodiment, the coder can work at other frequencies (such as 32 kHz) and with a different subdivision into sub-bands It is also possible to exploit the fact that the parameter ICLD [t, k] for k=0 can be disregarded. Its calculation and therefore its coding can be avoided. In this case, the coding of the ICLD parameters becomes:

for the frames of even index t: coding of a block of nine parameters $\{ICLD[t,k]\}_{k=1,\ldots,9}$ by non-uniform scalar quantization with:

5 bits for the first parameter ICLD [t, k] with k=1

4 bits for the next eight ICLD parameters for the frames of odd index t: coding of a block of ten parameters $\{ICLD[t,k]\}_{k=10,\ldots,19}$ as described previously 5 bits for the first ICLD parameter, 4 bits for the next eight ICLD parameters, 3 bits for the last (tenth) ICLD parameter.

Thus, in this embodiment, 37 bits are used for the frames of even index t and 40 bits are used for the frames of odd indices t.

Similarly, in a variant embodiment, instead of dividing the ICLD parameters into contiguous blocks, these parameters can be divided differently, for example by interleaving to obtain two parts: $\{ICLD[t,2k]\}_{k=0,\ldots,9}$ and $\{ICLD[t,2k+1]\}_{k=0,\ldots,9}$.

It should be noted that the coding method thus described is easily generalized to the case where the parameters are divided into more than two blocks. In a variant embodiment, the 20 ICLD parameters are divided into four blocks:

$$\{ICLD[t,k]\}_{k=0,\ldots,4},\{ICLD[t,k]\}_{k=5,\ldots,9},\{ICLD[t,k]\}_{k=10,\ldots,14} \text{ and } \{ICLD[t,k]\}_{k=15,\ldots,19}.$$

The coding of the ICLD parameters is then distributed over four successive frames with storage of the parameters decoded in the preceding frames on decoding. The calculation of the ICLD parameters must then be modified in order to include more than two frames in the calculation of the energies $\sigma_L^2[t,k]$ and $\sigma_R^2[t,k]$.

In this variant embodiment, the coding of the ICLD parameters can then use the following allocation:

5 bits for the first ICLD parameter 4 bits for the next four ICLD parameters with a total of 21 bits per frame. The bit rate is therefore even lower than in the preceding embodiment, the counterpart being that the ICLD parameters are re-updated in at least one block every 20 ms instead of every 10 ms. For some stereo parameters and depending on the type of signal, this variant may, however, introduce audible spatialization defects.

However, the benefit of transmitting the stereo or spatial parameters at a lower rate than that of the frames is still great. The imperfect auditory perception of the interchannel energy variations is thus exploited.

Finally, the coding method thus described applies to the coding of parameters other than the ICLD parameter. For example, the coherence parameter (ICC) can be calculated and transmitted selectively in a way similar to the ICLD.

The two parameters can also be calculated and coded according to the coding method described previously.

Figure 4:
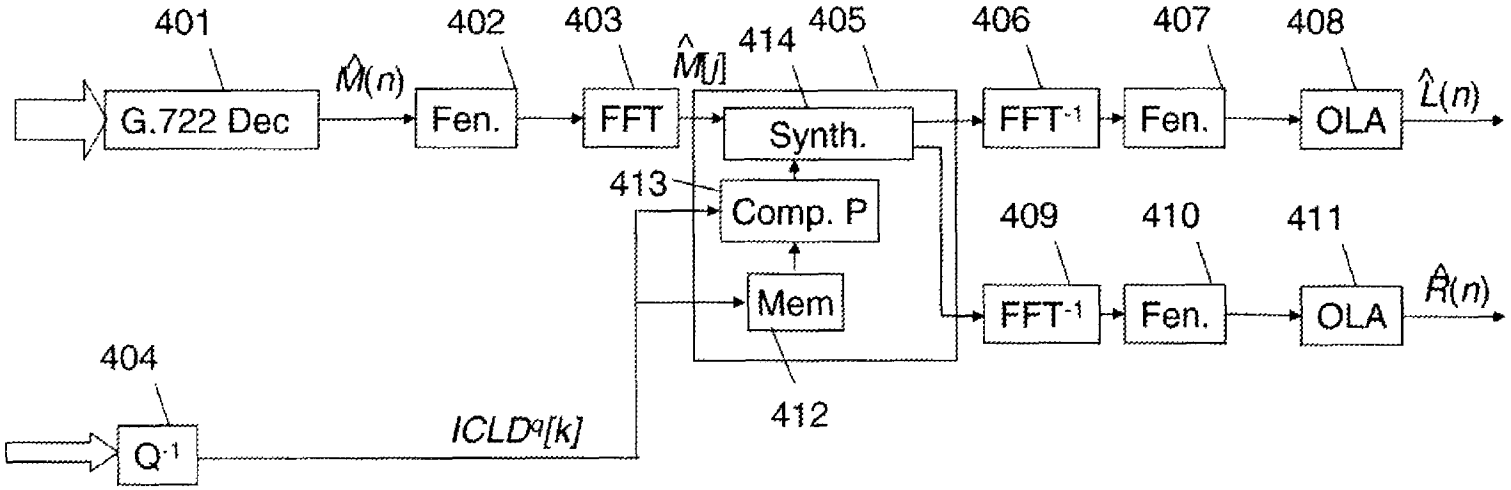
FIG. 4 illustrates a decoder according to one embodiment of the invention, implementing a decoding method according to one embodiment of the invention.

FIG. 4 illustrates a decoder in an embodiment of the invention and the decoding method that it implements.

The portion of the bit rate-scalable bit train received from the G.722 coder is demultiplexed and decoded by a G.722-type decoder (block 401) in the 56 or 64 Kbit/s mode. The synthesized signal obtained corresponds to the monosignal $\hat{M}(n)$ in the absence of transmission errors.

An analysis by short-term discreet Fourier transform with the same windowing as on the coder is performed on $\hat{M}(n)$ (blocks 402 and 403) to obtain the spectrum $\hat{M}[j]$.

The portion of the bit train associated with the stereo extension is also demultiplexed in the block 404.

The operation of the synthesis block 405 is now detailed.

For the frames t of even index, a first block of parameters $\{ICLD^q[t,k]\}_{k=0,\ldots,9}$ is decoded in the module 404 and these decoded parameters are stored in the module 412. For the frames t of odd index a second block of parameters $\{ICLD^q[t,k]\}_{k=10,\ldots,19}$ is decoded in the module 404 and these decoded parameters are stored in the module 412. A more detailed exemplary embodiment is, for example, as below:

For the quantization table:

$$tab_ild_q5[31]=\{-50,-45,-40,-35,-30,-25,-22,-19,-16,-13,-10,-8,-6,-4,-2,0,2,4,6,8,10,13,16,19,22,25,30,35,40,45,50\}$$

the decoding of an index i from 5 bits consists in synthesizing the parameter $ICLD^q[t,k]$ as $$ICLD^q[t,k]=tab_ild_q5(i)$$

Similarly, for the quantization table:

$$tab_ild_q4[15]=\{-16,-13,-10,-8,-6,-4,-2,0,2,4,6,8,10,13,16\}$$

the decoding of an index i from 4 bits consists in synthesizing the parameter $ICLD^q[t,k]$ as $$ICLD^q[t,k]=tab_ild_q4(i)$$

Finally, for the quantization table tab_ild_q3[7]={−16, −8, −4, 0, 4, 8, 16} the decoding of an index i from 3 bits consists in synthesizing the parameter $ICLD^q[t,k]$ as $$ICLD^q[t,k]=tab_ild_q3(i)$$

In the frames of even index, the values stored $\{ICLD^q[t-1,k]\}_{k=10,\ldots,19}$ in the preceding frame, in other words $ICLD^q[t,k]=ICLD^q[t-1,k]$ for k=10 . . . 19, are then used in the module 413, for the missing part of the parameters. Similarly, in the frames of odd index, the values stored in the preceding frame are used for the missing part $\{ICLD^q[t-1,k]\}_{k=0,\ldots,9}$.

The parameters for each of the frequency bands are thus obtained.

The spectra of the left and right channels are reconstructed by the synthesis module 414 by applying the parameters $\{ICLD^q[t-1,k]\}_{k=0,\ldots,19}$ thus decoded for each sub-band. This synthesis is performed, for example, as follows:

$$\begin{cases} \hat{L}[j] = c_1[t,k]\cdot\hat{M}[j], \\ \hat{R}[j] = c_2[t,k]\cdot\hat{M}[j], \end{cases} \quad (5)$$

$$j = B(k) \ldots B(k+1)-1$$

with

-continued $$\begin{cases} c_1[t,k] = \sqrt{\dfrac{2c^2[t,k]}{1+c^2[t,k]}} \\ c_2[t,k] = \sqrt{\dfrac{2}{1+c^2[t,k]}} \end{cases} \quad (6)$$

hence $$c[t,k] = 10^{ICLD[t,k]/20}$$

It should be noted that above computation of the scale factors is given by way of example. There are other ways of expressing the scale factors which can be implemented for the present invention.

The left and right channels $\hat{L}(n)$ and $\hat{R}(n)$ are reconstructed by inverse discrete Fourier transform (blocks 406 and 409) of the respective spectra $\hat{L}[j]$ and $\hat{R}[j]$ and add-overlap (blocks 408 and 411) with sinusoidal windowing (blocks 407 and 410).

Thus, the decoder described with reference to FIG. 4, in the particular stereo signal decoding embodiment, implements a parametric decoding method for a multichannel digital audio signal comprising a decoding step (G.722 Dec) for decoding a signal obtained from a channel reduction matrixing of the multichannel signal. The method also comprises the following steps:

- decoding ($Q^{-1}$) spatial information parameters received for a current frame of predetermined decoded signal length;
- storing (Mem) the parameters decoded for the current frame;
- obtaining (Comp.P) the parameters decoded and stored for at least one preceding frame and associating these parameters with those decoded for the current frame;
- reconstructing (Synth.) the multichannel signal from the decoded signal and from the association of parameters obtained for the current frame.

In the case of a division into more than two blocks of spatial information parameters, for example into four blocks as in a variant embodiment described previously, all the blocks of decoded parameters are obtained for four decoded frames.

The bit rate of the stereo extension is therefore reduced and obtaining these parameters makes it possible to reconstruct a good quality stereo signal.

It can also be noted that alternative techniques to the coding of the parameters (ICLD, ICPD, ICC) can be adopted to implement the coding method according to the invention.

Thus, in a variant embodiment, the module 314 of the parameter extraction block of FIG. 3 differs.

This module in this embodiment makes it possible to obtain other stereo parameters by applying a principle component analysis (PCA) such as that described in the paper by Manuel Briand, David Virette and Nadine Martin entitled "Parametric coding of stereo audio based on principal component analysis" published at the DAFX conference, 1991.

Thus, a principal component analysis is performed for each sub-band. The left and right channels analyzed in this way are then modified by rotation in order to obtain a principal component and a secondary component qualified as ambience. The stereo analysis produces, for each sub-band, a rotation angle (θ) parameter and an energy ratio between the principal component and the ambience signal (PCAR which stands for Principal Component to Ambience energy Ratio).

The stereo parameters then consist of the rotation angle parameter and the energy ratio (θ and PCAR).

Figure 6:
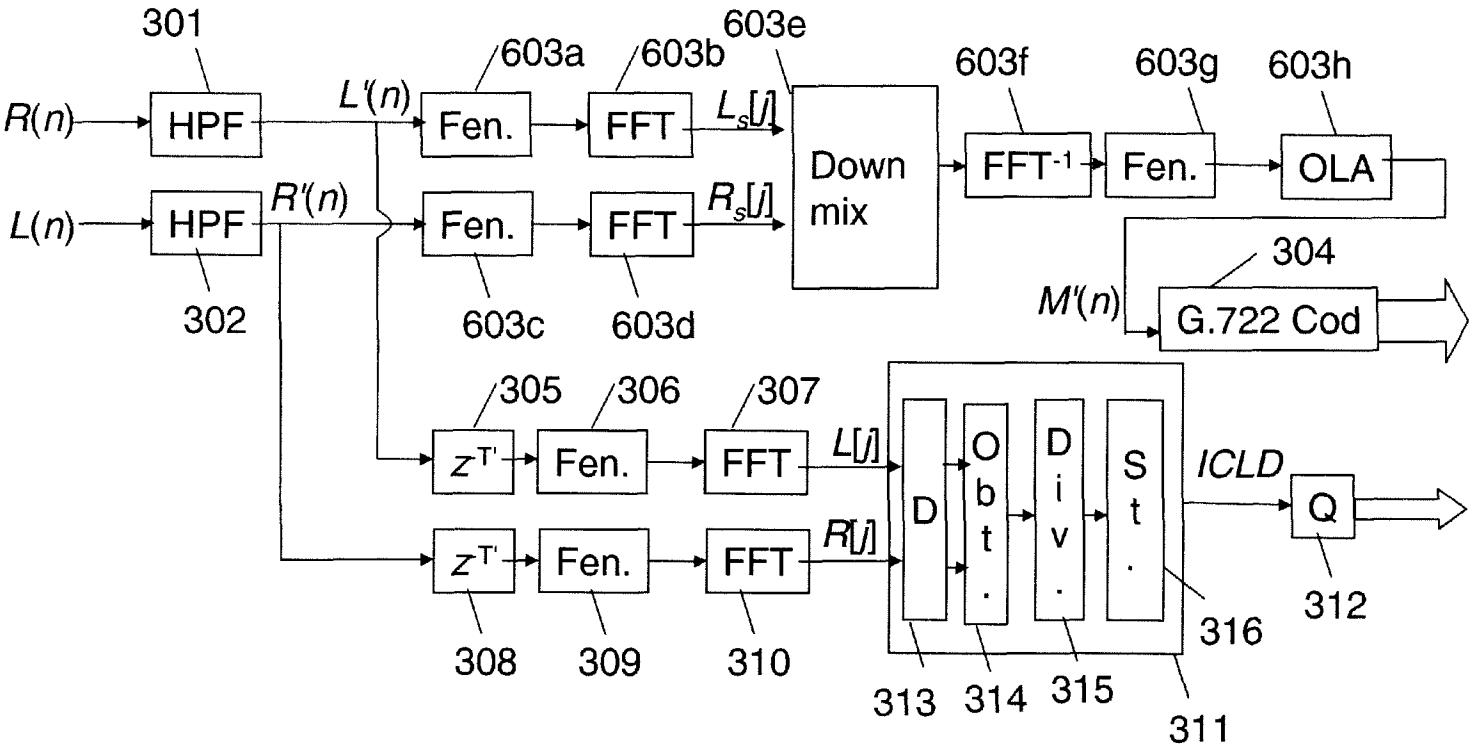
FIG. 6 illustrates a coding method and a coder according to another embodiment of the invention.

FIG. 6 illustrates another embodiment of a coder according to an embodiment of the invention.

Compared to the coder of FIG. 3, here it is matrixing, or "downmix" block 303 which differs. In the example of FIG. 3, the "downmix" operation has the advantage of being instantaneous and of minimal complexity.

However, this operation does not necessarily allow for a conservation of energy. An enhancement of this "downmix" operation is possible in the time domain, for example with a calculation of the form $M(n)=w_1L(n)+w_2R(n)$ and of the adaptive weights $w_1$ and $w_2$, or even in the frequency domain as represented here with reference to FIG. 6.

The "downmix" operation here consists of the blocks 603*a*, 603*b*, 603*c* and 603*d* for the transition to the frequency domain.

The calculation of the monosignal is performed in the "downmix" block 603*e* in which the signal is calculated in the frequency domain by the following formula:

$$M'[j] = \frac{|L'[j]| + |R'[j]|}{2} \cdot e^{j\angle L'(j)} \quad (7)$$

in which $|\cdot|$ represents the amplitude (complex module) and $\angle(\cdot)$ the phase (complex argument).

The blocks 603*f*, 603*g* and 603*h* are used to bring the monosignal into the time domain in order to be coded by the block 304 as for the coder illustrated in FIG. 3.

An offset of T'=80+T samples is then obtained, or an offset of 80+80+22=182 samples.

This offset makes it possible to synchronize the time frames of the left/right channels and those of the decoded monosignal.

An embodiment of the invention has been described here in the case of a G.722 coder/decoder. It can obviously be applied to the case of a modified G.722 coder, for example one including noise reduction ("noise feedback") mechanisms or including a scalable G.722 with supplementary information. An embodiment of the invention can also be applied in the case of a monocoder other than that of G.722 type, for example, a G.711.1-type coder. In the latter case, the delay T must be adjusted to take into account the delay of the G.711.1 coder.

Similarly, the time-frequency analysis of the embodiment described with reference to FIG. 3 could be replaced according to different variants:

- windowing other than sinusoidal windowing could be used,
- an overlap other than the 50% overlap between successive windows could be used,
- a frequency transform other than the Fourier transform, for example a modified discrete cosine transform (MDCT), could be used.

The embodiments described previously dealt with the case of a multichannel signal of stereo signal type but an implementation of the invention also extends to the more general case of the coding of multichannel signals (with more than two audio channels) from a mono or even stereo "downmix".

In this case, the coding of the spatial information involves the coding and the transmission of spatial information parameters. Such is, for example, the case of signals with 5.1 channels comprising a left (L), right (R), centre (C), left rear (Ls for Left surround), right rear (Rs for Right surround), and subwoofer (LFE for Low Frequency Effects) channels. The spatial information parameters of the multichannel signal then take into account the differences or the coherences between the different channels.

The coders and decoders as described with reference to FIGS. 3, 4 and 6 can be incorporated in such multimedia equipment as set-top boxes, computers, or even communication equipment such as mobile telephones or personal digital assistants.

Figure 7A:
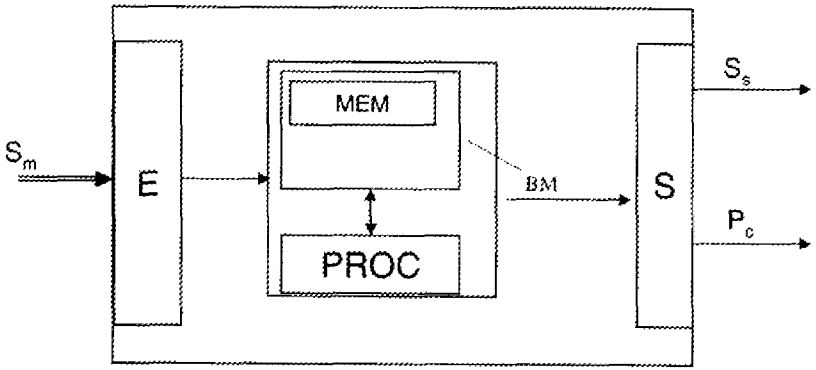
FIGS. 7*a* and 7*b* respectively illustrate a device capable of implementing the coding method and the decoding method according to one embodiment of the invention.

FIG. 7*a* represents an example of such a multimedia equipment item or coding device comprising a coder according to the invention. This device comprises a processor PROC cooperating with a memory block BM comprising a storage and/or working memory MEM.

The memory block may advantageously contain a computer program comprising code instructions for implementing the steps of the coding method in the sense of an embodiment of the invention, when these instructions are executed by the processor PROC, and in particular the steps:

of obtaining, for each frame of predetermined length, spatial information parameters of the multichannel signal;

of dividing spatial information parameters into a plurality of parameter blocks of selecting a block of parameters according to the index of the current frame;

of coding the block of parameters selected for the current frame.

Typically, the description of FIG. 3 comprises the steps of an algorithm of such a computer program. The computer program may also be stored on a readable medium that can be read by a reader of the device or that can be downloaded into the memory space of the equipment.

The device comprises an input module capable of receiving a multichannel signal $S_m$ representing a sound scene, either via a communication network, or by reading a content stored on a storage medium. This multimedia equipment item may also comprise means for capturing such a multichannel signal.

The device comprises an output module capable of transmitting the coded spatial information parameters $P_c$ and a sum signal Ss obtained from the coding of the multichannel signal.

Figure 7B:
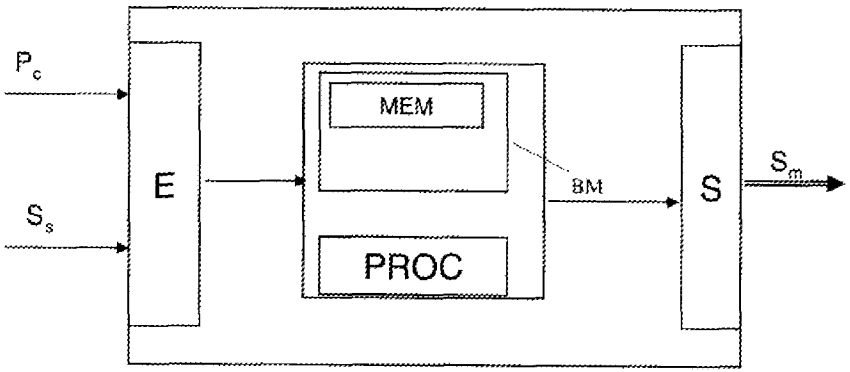

Similarly, FIG. 7*b* illustrates an example of multimedia equipment or of a decoding device comprising a decoder according to the invention.

This device comprises a processor PROC cooperating with a memory block BM comprising a storage and/or working memory MEM.

The memory block may advantageously contain a computer program comprising code instructions for implementing the steps of the decoding method in the sense of an embodiment of the invention, when these instructions are executed by the processor PROC, and in particular the steps of:

decoding spatial information parameters received for a current frame of predetermined decoded signal length;

storing the parameters decoded for the current frame;

obtaining the parameters decoded and stored for at least one preceding frame and associating these parameters with those decoded for the current frame;

reconstructing the multichannel signal from the decoded signal and from the association of parameters obtained for the current frame.

Typically, the description of FIG. 4 reprises the steps of an algorithm of such a computer program. The computer program may also be stored on a memory medium that can be read by a reader of the device or that can be downloaded into the memory space of the equipment.

The device comprises an input module capable of receiving the coded spatial information parameters $P_c$ and a sum signal $S_s$ originating, for example, from a communication network. These input signals may originate from a read on a storage medium.

The device comprises an output module capable of transmitting a multichannel signal decoded by the decoding method implemented by the equipment.

This multimedia equipment may also comprise playback means of loudspeaker type or communication means capable of transmitting this multichannel signal.

Obviously, such a multimedia equipment item may comprise both the coder and the decoder according to an embodiment of the invention. The input signal will then be the original multichannel signal and the output signal the decoded multichannel signal.

The invention claimed is:

1. A parametric coding method for a multichannel digital audio signal, wherein the method comprises the following steps performed using a processor of a coding device:

coding a signal from a channel reduction matrixing of the multichannel signal;

obtaining, for each frame of the multichannel signal of predetermined length, spatial information parameters of the multichannel signal;

dividing the spatial information parameters into a plurality of blocks of parameters;

selecting a block of parameters to be coded as a function of an index of a current frame to be coded; and coding the spatial information parameters of the block of parameters selected for the current frame, so that coding bit rate is distributed over a number of the frames.

2. The coding method as claimed in claim 1, wherein the spatial information parameters are obtained by the following steps:

frequency transformation of the multichannel signal to obtain the spectra of the multichannel signal, for each frame;

subdivision, for each frame, of the spectra of the multichannel signal, into a plurality of frequency sub-bands, and computation of the spatial information parameters for each frequency sub-band.

3. The method as claimed in claim 2, dividing the spatial information parameters is performed as a function of the frequency sub-bands obtained by subdivision.

4. The method as claimed in claim 1, wherein said spatial information parameters are defined as the energy ratio between the channels of the multichannel signal.

5. The method as claimed in claim 1, wherein the coding of spatial information parameters of a block of parameters is performed by non-uniform scalar quantization.

6. The method as claimed in claim 3, wherein dividing the parameters is performed to obtain a first block corresponding to the parameters of the first frequency sub-bands and a second block corresponding to the parameters of the last frequency sub-bands obtained by subdivision.

7. The method as claimed in claim 3, dividing the parameters is performed to obtain two blocks interleaving the parameters of the different frequency sub-bands.

8. The method as claimed in claim 6, wherein the coding of the parameters of the first block and of the second block is performed according to whether the frame to be coded has an even index or an odd index.

9. The method as claimed in claim 1, wherein the method further comprises a principal component analysis step to obtain the spatial information parameters comprising a rotation angle parameter and an energy ratio between a principal component and an ambience signal.

10. A parametric decoding method for a multichannel digital audio signal, the method comprising the following steps performed using a processor of a decoding device:

decoding a signal from a channel reduction matrixing of the multichannel signal;

decoding spatial information parameters received for a current frame of predetermined length of the decoded signal;

storing the decoded parameters for the current frame;

obtaining the decoded and stored parameters of at least one preceding frame and associating these parameters with those decoded for the current frame to obtain spatial information parameters received over a number of successive frames of the decoded signal; and reconstructing the multichannel signal from the decoded signal and from the association of parameters obtained for the current frame.

11. The method as claimed in claim 10, wherein the decoded and stored parameters of a preceding frame correspond to the parameters of the first frequency sub-bands of the decoding frequency band and the decoded parameters of the current frame correspond to the parameters of the last frequency sub-bands obtained by subdivision or vice versa.

12. A non-transitory computer-readable memory comprising a computer program stored thereon and comprising code instructions for implementing a parametric coding method for a multichannel digital audio signal when the instructions are executed by a processor, wherein the instructions comprise:

instructions that configure the processor to code a signal from a channel reduction matrixing of the multichannel signal;

instructions that configure the processor to obtain, for each frame of the multichannel signal of predetermined length, spatial information parameters of the multichannel signal;

instructions that configure the processor to divide the spatial information parameters into a plurality of blocks of parameters;

instructions that configure the processor to select a block of parameters to be coded as a function of an index of a current frame to be coded; and instructions that configure the processor to code the spatial information parameters of the block of parameters selected for the current frame, so that coding bit rate is distributed over a number of the frames.

13. A non-transitory computer-readable memory comprising a computer program stored thereon and comprising code instructions for implementing, a parametric decoding method for a multichannel digital audio signal when the instructions are executed by a processor, wherein the instructions comprise:

instructions that configure the processor to decode a signal from a channel reduction matrixing of the multichannel signal;

instructions that configure the processor to decode spatial information parameters received for a current frame of predetermined length of the decoded signal;

instructions that configure the processor to store the decoded parameters for the current frame;

instructions that configure the processor to obtain the decoded and stored parameters of at least one preceding frame and associating these parameters with those decoded for the current frame to obtain spatial information parameters received over a number of successive frames; and instructions that configure the processor to reconstruct the multichannel signal from the decoded signal and from the association of parameters obtained for the current frame.

14. A parametric coding device for coding a multichannel digital audio signal, the coding device comprising:

a memory comprising instructions stored thereon;

a processor configured by the instructions to perform steps of:

coding a signal from a channel reduction matrixing of the multichannel signal;

obtaining, for each frame of the multichannel signal of predetermined length, spatial information parameters of the multichannel signal;

dividing the spatial information parameters into a plurality of blocks of parameters;

selecting a block of parameters to be coded as a function of the index of a current frame to be coded; and coding the block of parameters selected for the current frame, so that coding bit rate is distributed over a number of the frames.

15. A parametric decoding device for decoding a multichannel digital audio signal, the decoding device comprising:

at least one memory comprising instructions stored thereon;

a processor configured by the instructions to perform steps of:

decoding a signal from a channel reduction matrixing of the multichannel signal;

decoding spatial information parameters received for a current frame of predetermined length of the decoded signal;

storing the parameters for the current frame in a storage space within the at least one memory;

a module configured to obtain the decoded and stored parameters of at least one preceding frame and associating these parameters with those decoded for the current frame to obtain spatial information parameters received over a number of successive frames; and a reconstruction module configured to reconstruct the multichannel signal from the decoded signal and from the association of parameters obtained for the current frame.

16. The method as claimed in claim 7, wherein the coding of the parameters of the first block and of the second block is performed according to whether the frame to be coded has an even index or an odd index.

* * * * *

UNITED STATES PATENT AND TRADEMARK OFFICE

CERTIFICATE OF CORRECTION

PATENT NO. : 9,167,367 B2
APPLICATION NO. : 13/502316
DATED : October 20, 2015
INVENTOR(S) : Thi Minh Nguyet Hoang et al.

It is certified that error appears in the above-identified patent and that said Letters Patent is hereby corrected as shown below:

Specification

In column 2, line 18, delete:

$$\text{“}\ \mathrm{ICPD}[k]=\angle(\Sigma_{j=B[k]}^{B[k+1]-1}L[j]\cdot R^{*}[j])\ \text{”}$$

and insert therefor:

$$\text{--}\ \mathbf{ICPD}[k]=\angle\left(\sum_{j=B[k]}^{B[k+1]-1}L[j]\cdot R^{*}[j]\right)\ \text{--}.$$

Signed and Sealed this
Nineteenth Day of April, 2016

Michelle K. Lee

Michelle K. Lee
*Director of the United States Patent and Trademark Office*